US008733310B2

(12) United States Patent
Mock et al.

(10) Patent No.: US 8,733,310 B2
(45) Date of Patent: May 27, 2014

(54) FINGER FOLLOWER LEVER FOR ACTUATING A GAS EXCHANGE VALVE

(75) Inventors: Stephan Mock, Pretzfeld (DE); Jochen Viertel, Hochstadt (DE)

(73) Assignee: Schaeffler Technologies GmbH & Co. KG, Herzogenaurach (DE)

( * ) Notice: Subject to any disclaimer, the term of this patent is extended or adjusted under 35 U.S.C. 154(b) by 98 days.

(21) Appl. No.: 13/487,535

(22) Filed: Jun. 4, 2012

(65) Prior Publication Data

US 2012/0312264 A1 Dec. 13, 2012

(30) Foreign Application Priority Data

Jun. 7, 2011 (DE) ..... 10 2011 077 024

(51) Int. Cl.
*F01L 1/18* (2006.01)

(52) U.S. Cl.
USPC ..... 123/90.39; 123/90.16; 74/559

(58) Field of Classification Search
USPC ..... 123/90.39, 90.16; 74/559, 569
See application file for complete search history.

(56) References Cited

U.S. PATENT DOCUMENTS 7,318,402 B2 * 1/2008 Harman et al. ..... 123/90.39

FOREIGN PATENT DOCUMENTS

JP 07063013 3/1995

* cited by examiner

*Primary Examiner* — Zelalem Eshete
(74) *Attorney, Agent, or Firm* — Volpe and Koenig, P.C.

(57) ABSTRACT

A finger follower lever for actuating gas exchange valves of an internal combustion engine, having a lever body formed by two parallel side walls spaced apart by a transversely extending web. The web forms a first, joint socket end as a pivotable support for the lever, and a second end with a valve actuating surface. A cam roller is rotatably held between the side walls via a needle ring of a needle bearing. The cam roller projects partially via an aperture in the web for cam contact. The cam roller is narrow, and the needle ring projects beyond the cam roller at one axial end, and ends directly adjacent to a corresponding side wall. The aperture has a cross section defined by an overlap between a first, cam roller pocket with an extent corresponding to the cam roller in the axial direction, and a second pocket for the needle ring.

7 Claims, 3 Drawing Sheets

FINGER FOLLOWER LEVER FOR ACTUATING A GAS EXCHANGE VALVE

CROSS-REFERENCE TO RELATED APPLICATIONS

This application claims the benefit of German Patent Application No. 102011077024.0, filed Jun. 7, 2011, which is incorporated herein by reference as if fully set forth.

FIELD OF THE INVENTION

The invention relates to a finger follower lever for actuating a gas exchange valve of an internal combustion engine, having a lever body, which is formed by two parallel side walls, which are spaced apart, and by a transversely extending web, which connects the side walls, the web forming in the region of a first end a joint socket which serves to provide pivotable support for the lever body, and defining in the region of a second end a valve actuating surface provided for contact with the gas exchange valve, the side walls accommodating between them, in holes, an axle pin which guides a cam roller rotatably via a needle ring of a needle bearing, and the web defining a downwardly-open U-shaped profile of the lever body together with the side walls, at least between the second end and a positioning region of the cam roller, through which profile the cam roller projects partially via an aperture in the web for contact with a cam on a camshaft.

BACKGROUND

Finger follower levers are used within the valve drive of internal combustion engines with overhead camshafts, acting as a transmission element situated between a cam on a camshaft and a respective gas exchange valve to be actuated in order to introduce a translatory motion into the gas exchange valve in accordance with a contour of the cam. A finger follower lever generally has a one-armed lever body, one end of which is supported on a supporting element connected to a cylinder head of the internal combustion engine and the other end of which is connected by way of a valve actuating surface to a valve stem of the gas exchange valve to be actuated. In a central section of the lever body, a sliding surface is then formed or a cam roller is arranged, against which the cam on the camshaft then runs and brings about a pivoting motion of the finger follower lever in accordance with its contour. The use of a cam roller which rolls on the circumference of the respective cam during the operation of the internal combustion engine has the advantage that the friction in the valve drive can be considerably reduced, thus also making it possible to achieve a considerable reduction in consumption during the operation of the respective internal combustion engine.

PRIOR ART

JP 07063013 A discloses a finger follower lever of this type, the lever body of which is composed of two parallel side walls, which are spaced apart, and by an interposed web, the latter connecting the two side walls to one another. In the region of a first end of the web, a joint socket is formed for the purpose of providing pivotable support for the lever body from the respective supporting element in the cylinder head in the installed state of the finger follower lever. In the region of a second end, on the other hand, the web defines a valve actuating surface, by which contact is established with a valve stem of the respective gas exchange valve after installation.

Moreover, the side walls guide between them a cam roller, in which an axle pin that carries the cam roller is accommodated in holes in the side walls. Arranged on this axle pin is a needle ring of a needle bearing, by which the cam roller is rotatably mounted. Finally, between its second end and the region of the cam roller, the web defines a U-shaped profile of the lever body together with the side walls, the profile being oriented with its opening downward and the cam roller projecting partially through the profile via an aperture in the web. Through the use of this protruding part, the cam roller runs against a cam on a camshaft in the installed state of the finger follower lever

SUMMARY

Starting from the prior art described above, it is then the object of the present invention to make available a finger follower lever for actuating a gas exchange valve which, on the one hand, allows good valve guidance in the region of the valve actuating surface and has a low mass and, on the other hand, is suitable for use in restricted installation space conditions, being embodied with a cam roller which is as narrow as possible. In particular, this finger follower lever should have sufficient clearance in the region of the outer circumference of the cam roller for use in a variable valve drive.

This object is achieved in a finger follower lever according to the developments of the invention.

According to the invention, a finger follower lever for actuating a gas exchange valve of an internal combustion engine has a lever body, which is comprised of two parallel side walls, which are spaced apart, and of a transversely extending web, which connects the side walls. In the region of a first end, the web forms a joint socket which serves to provide pivotable support for the lever body in the installed state of the finger follower lever. In the region of a second end of the web, opposite the first end, on the other hand, a valve actuating surface is defined, by which contact is established with the respective gas exchange valve in the installed state. Furthermore, the side walls accommodate between them, in holes, an axle pin which guides a cam roller rotatably via a needle ring of a needle bearing. Finally, the web defines a downwardly-open U-shaped profile of the lever body (that is to say a U-shaped profile oriented with the opening in the direction of the gas exchange valve) together with the side walls, at least between the second end and a region in which the cam roller is positioned, through which profile the cam roller projects partially via an aperture in the web for contact with a cam on a camshaft.

In the context of the invention, the needle ring of the needle bearing is either a cageless full-roller design or cage-guided, in which needles of the needle ring either roll directly on the axle pin or on an interposed inner ring at an inside diameter of the needle ring, said inner ring then being mounted on the axle pin. With respect to the cam roller too, there is the possibility either for the needles to roll directly on an inside diameter of the cam roller or for an interposed outer ring to be provided, which is then connected in an appropriate manner to the separate cam roller. The set of needles in the needle ring can furthermore also be replaced by a sliding ring, which then allows the relative motion between the axle pin and the cam roller.

The invention now comprises the technical teaching that the needle ring projects beyond the cam roller at least at one axial end, and ends directly adjacent to the corresponding side wall of the lever body at the at least one axial end. Moreover, the web extends at a tangent to a radial extent of the needle ring in the positioning region of the cam roller, and the aperture has a cross section which is defined by an overlap between a first pocket for the cam roller, said pocket having an extent corresponding to the cam roller in the axial direction, and a second pocket for the needle ring. In other words, therefore, the needle ring has a greater extent in the axial direction than the surrounding cam roller, and the web extends at least partially at the level of the radial extent of the needle ring in the region of the cam roller. The aperture in the web has a cross section which is composed of an overlap between the first and the second pocket.

Such a design of a finger follower lever has the advantage that the surface pressures which arise in the needle bearing can be kept low, despite the use of a narrow cam roller. This is because the Hertzian stress on an inner race of the needle bearing is significantly greater, due to the small radius of curvature, than at an outer race, which has a large radius of curvature. Through the use of the axial increase in the length of the needles relative to the cam roller and the fact that they roll on the inner race over their entire axial length, the surface pressure on the inner race can now be reduced due to the resulting increase in the effective length, and this increases the life of the needle bearing accordingly. At the same time, the narrow construction of the cam roller and the profile of the web in the region of the cam roller means that the finger follower lever is suitable for use in the region of variable valve drive, in which the prevailing installation space conditions are generally tight in the region of the cams. This is because the narrow roller and the clearance formed with respect to the lever body in the region of the cam roller enables the finger follower lever to be positioned very closely adjacent to a cam on the camshaft. As a result, it is possible to use the finger follower lever according to the invention in a variable valve drive in the form of a sliding cam system, in which different lifts and/or timings of a respective gas exchange valve are defined by corresponding individual cams on a cam member that can be moved axially with respect to the respective camshaft. In a system of this kind, the differences in the cam lifts of the individual cams, which are in some cases very great, mean namely that a sufficient clearance between the individual cams and the lever body has to be ensured at all times in order to avoid a collision.

Moreover, the design of the lever body means that the finger follower lever according to the invention is distinguished by good valve guidance in the region of the valve actuating surface and a low mass and hence also low inertia. Finally, the special configuration of the aperture in the web means that, despite the fact that the web extends at the level of the radial extent of the needle ring, there is, on the one hand, sufficient guidance for the needles of the needle ring on the side walls and, on the other hand, good guidance of the cam roller. The latter results in low axial backlash, and therefore a low tendency for tilting during the axial movement of the cam member relative to the finger follower lever is achieved in the case of use in the region of a sliding cam system.

In contrast, the finger follower lever in JP 07063013 A is not suitable for use in the region of restricted installation space conditions since the cam roller is of very wide configuration in the axial direction and the web is guided past a long way above in the region of the cam roller. Accordingly, it is not possible to ensure sufficient clearance in the region of the cam roller, and use with a variable valve drive, such as a sliding cam system, is therefore not possible.

According to an advantageous embodiment of the invention, the needle ring projects axially beyond the cam roller on both sides and ends directly adjacent to the side walls at the axial ends, the second pocket having an extent corresponding to the needle ring in the axial direction. By this measure, it is possible to keep the Hertzian stress at the inner circumference at the lowest level during operation since in this case the maximum possible length between the side walls is used as a rolling surface. At the same time, the second pocket and hence also the aperture has a cross section which is suitable for accommodating the needle ring. However, it is also conceivable, within the scope of the invention, to make the needle ring project on only one side of the cam roller and, on the other side, either to have the needle ring and the cam roller end at the corresponding side wall or to bridge an interspace between the needle ring and the corresponding side wall with a corresponding spacer element, which then guides the needles of the needle ring. In the latter case, a cross section of the second pocket in the axial direction would then be defined by an axial extent of the needle ring and an axial extent of the spacer element.

As a development of the invention, the tangent-forming profile of the web in the region of the cam roller is formed by a flat. This measure allows precise configuration of the contour of the lever body in the region of the cam roller and hence precise configuration of the clearance in this region. It is conceivable in this context to produce this flat as part of a forming production process or of a cutting process.

According to one embodiment of the invention, the U-shaped profile of the lever body is defined over the entire length of the web. An embodiment of this kind has the advantage that the lever body can accordingly be produced in a simple manner from a sheet-metal blank in the context of a forming process that does not involve machining and, at the same time, has adequate stiffness. Moreover, this improves lateral guidance on a supporting element in the region of the joint socket too.

As a development of the invention, a holding clip is provided on the same side as the joint socket. This holding clip, which is preferably guided by means of an upper side over an outer contour of the joint socket and has longitudinal spring arms on the same side as the supporting element, makes it a simple matter to mount the finger follower lever according to the invention in the cylinder head on the supporting element. This is because the longitudinal spring arms of the holding clip, which extend below the joint socket and on the same side as the supporting element, hold the finger follower lever in position after it has been mounted on the respective supporting element since the longitudinal arms reach behind a supporting element head that projects into the joint socket.

According to another advantageous embodiment of the invention, the lever body is designed as a sheet-metal part. Consequently, it is a simple matter to produce the finger follower lever from sheet-metal blanks and to produce it at least predominantly in a forming process. It is advantageous here if the lever body is of symmetrical design with respect to a longitudinal center plane, since the relatively simple geometric shape allows the use of an advantageous production method.

The invention is not restricted to the indicated combination of features in the main claim or in the dependent claims. There are furthermore possibilities of combining individual features, including those which emerge from the claims, the following description of an embodiment of the invention or directly from the drawings. The fact that the claims refer to the drawings through the use of reference signs is not intended to restrict the scope of the claims.

BRIEF DESCRIPTION OF THE DRAWINGS

Further advantageous embodiments will emerge from the following description of a preferred embodiment of the invention, which refers to the Figures illustrated in the following drawings, in which.

DETAILED DESCRIPTION OF THE PREFERRED EMBODIMENTS

Figure 1:
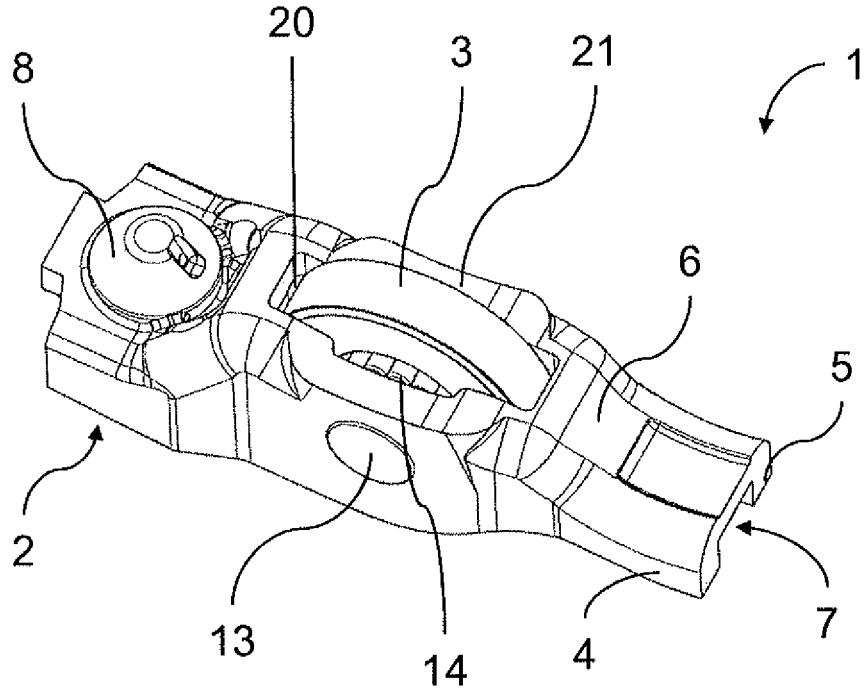
FIG. 1 shows a perspective view of a finger follower lever according to the invention in accordance with a preferred embodiment of the invention.

In FIGS. 1 to 5, 1 denotes a finger follower lever, which is comprised of a lever body 2 having a U-shaped profile and of a cam roller 3. The lever body 2 is formed by two parallel side walls 4 and 5, which are spaced apart, and by a transversely extending web 6, which connects the side walls 4 and 5, this being apparent especially from the front view in FIG. 2. In the region of a first end of the web 6, a valve actuating surface 7 is formed on an underside of the web 6, said underside being situated within the U-shaped profile of the lever body 2, by which valve actuating surface the lever body 2 rests on one end of a valve stem of an associated gas exchange valve in the installed state. In this region, the side walls 4 and 5 furthermore provide lateral guidance for the valve stem. At the opposite end of the web 6, in contrast, as is apparent from FIGS. 1 to 5, a joint socket 8 is formed in the web 6, by which socket a connection to a supporting element provided in a cylinder head of the respective internal combustion engine is established in the installed state, the lever body 2 then being supported pivotably in the cylinder head by said supporting element.

In particular, the length of this supporting element can be adjusted hydraulically, thus shifting an articulation point of the lever body 2 in such a way that any valve backlash arising between the valve actuating surface 7 and the respective valve stem end of the gas exchange valve can be compensated. It is furthermore also possible for the supporting element to be a switchable supporting element, which either implements the abovementioned function in a normal mode or, in an actuated position, is deflected inward, thus ensuring that a movement initiated by a cam on the respective camshaft does not lead to opening of the gas exchange valve but to inward deflection of the supporting element, that is to say that the lever body 2 performs a pivoting movement about the valve stem end in this case.

Figure 2:
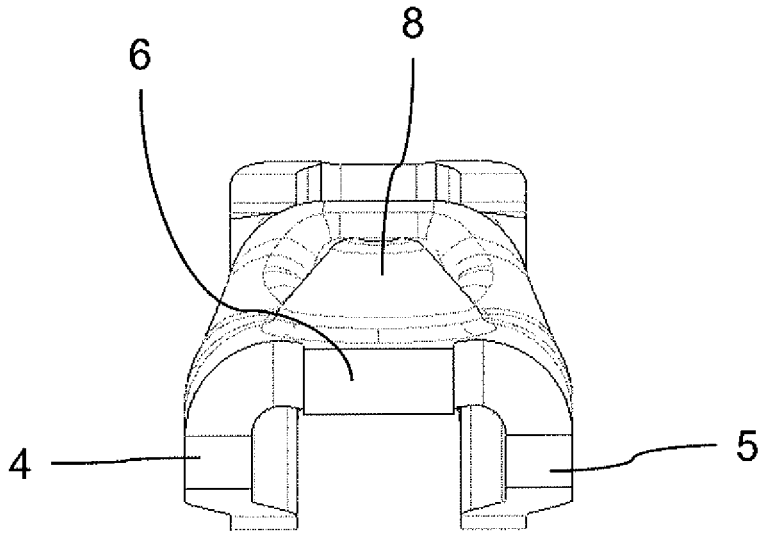
FIG. 2 shows a front view of the finger follower lever according to the invention as per FIG. 1.

As can furthermore be seen especially from FIG. 2, in which the cam roller 3 is not shown for the sake of clarity, the spacing between the two side walls 4 and 5 is enlarged in the region of the joint socket 8 to create sufficient space for attachment to the supporting element in this region. Moreover, a holding clip 9 is provided on the same side as the joint socket 8, although said clip is shown only in FIGS. 3 to 5 for the sake of clarity. By means of said holding clips 9, mounting the finger follower lever 1 according to the invention in the respective cylinder head of the internal combustion engine is simplified since the holding clip 9 holds the finger follower lever 1 after placement on the supporting element. For this purpose, an upper side 10 of the holding clip 9 reaches over an outer contour of the joint socket 8, and two parallel longitudinal arms 11 and 12 of said clip project in the axial direction on the underside of the web 6, into the region of attachment of the lever body 2 on the respective supporting element. The longitudinal arms 11 and 12 extend at a distance from one another which is less than an opening diameter of the joint socket 8, and are furthermore of resilient design. As a result, the longitudinal arms 11 and 12 are opened out when a head of the respective supporting element is inserted into the joint socket 8, and they snap back after the insertion of the head corresponding to the joint socket 8, thus engaging behind the head of the supporting element.

Moreover, the side walls 4 and 5 accommodate between them, in holes, an axle pin 13 which guides the cam roller 3 via a needle bearing having a needle ring 14. As can be seen especially in combination with the sectional view in FIG. 5. The needle ring 14 has a plurality of needles 15, which roll without a cage on an inner ring 16, which thus forms an inner race 17 for the needles 15 and is held by the axle pin 13. An outer race 18, on the other hand, is defined by an inner circumference of the cam roller 3, which furthermore forms a cam contact surface 19 on an outer circumference for contact with a cam on a camshaft and, for the purpose of this contact, projects through the web 6 via an aperture 20. The inner circumference of the cam roller 3 is provided with a profile that avoids edge support with respect to the needles 15 and hence stress peaks.

Figure 3:
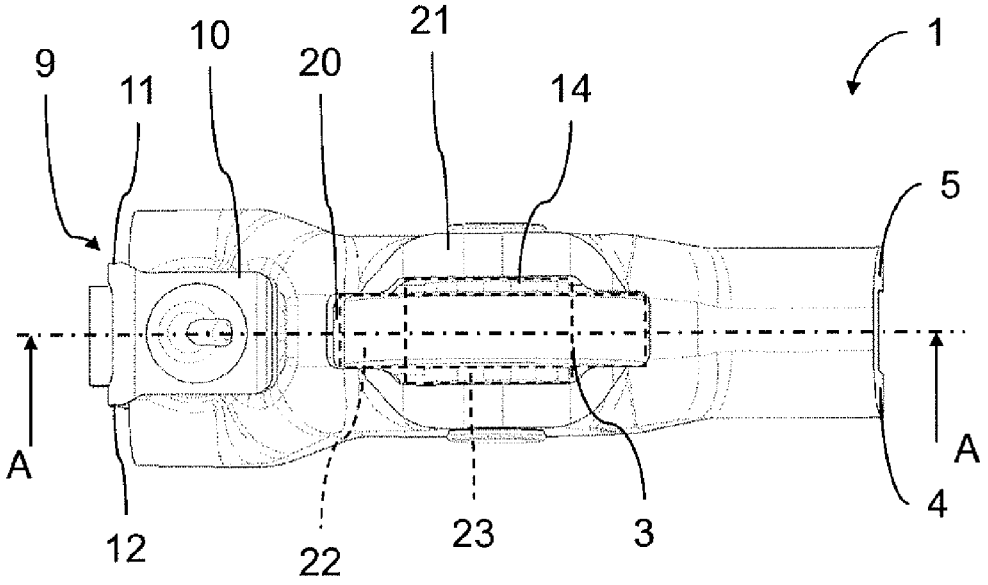
FIG. 3 shows a plan view of the finger follower lever according to the invention as shown in FIG. 1.
Figure 4:
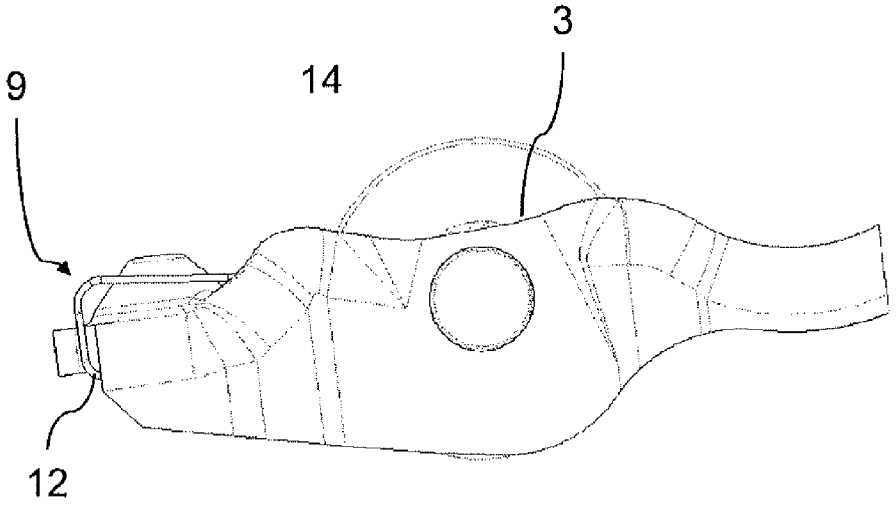
FIG. 4 shows a side view of the finger follower lever according to the invention as shown in FIG. 1.
Figure 5:
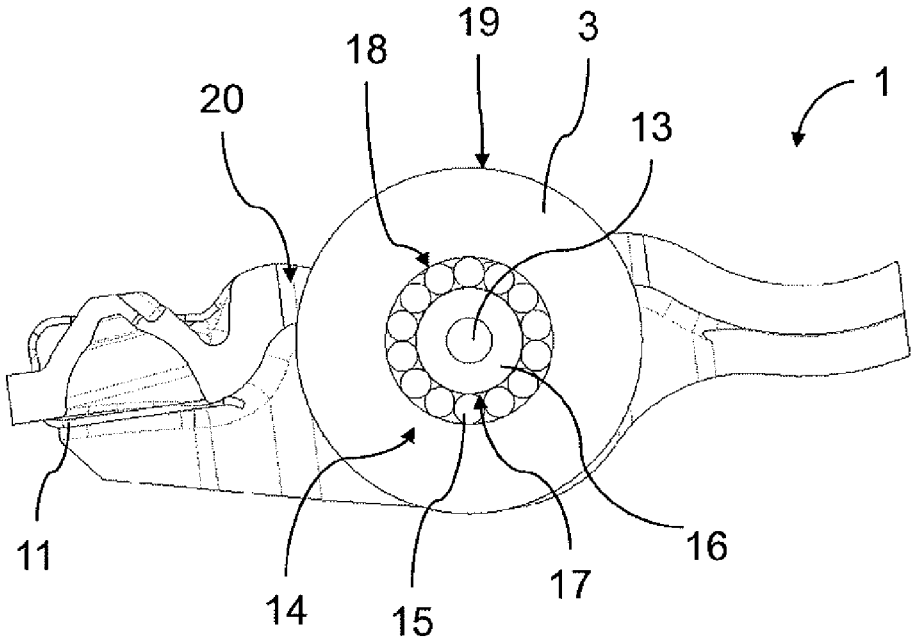
FIG. 5 shows a longitudinal section along the line A-A in FIG. 3.

As is furthermore apparent especially from the plan view in FIG. 3, the needle ring 14 projects axially beyond the cam roller 3 on both sides, ending directly adjacent to the side walls 4 and 5 at the axial ends, with the result that the needles 15 are each guided on the side walls 4 and 5. Accordingly, with what is thus a wider embodiment of the needle ring 14 in relation to the cam roller 3, it is possible to keep down an effective surface pressure on the inner ring 16 due to the larger effective running surface there, despite using a cam roller 3 of narrower construction. The narrow construction of the cam roller 3 makes the finger follower lever 1 particularly suitable for variable valve drive, in which a cam contour is moved transversely to the finger follower lever 1 to change the timing of the respective gas exchange valve. Thus, for example, this valve drive can take the form of cam members which are each composed of a plurality of adjacent individual cams and can be moved axially in a specific manner relative to the respective camshaft so that a different individual cam with a different lift contour comes into contact with the cam roller 3 of the finger follower lever 1 in each case. However, in order to ensure sufficient free space next to the cam contact surface 19, the web 6 extends at a tangent to a radial extent of the needle ring 14 in the region of the cam roller 3, this being particularly apparent from the side view in FIG. 4. It can be seen here that the needle ring 14 likewise projects partially through the aperture 20. To form this profile of the web 6, the web 6 is provided in this region with a flat 21, which correspondingly reduces the effective height of the web 6 in this region and thus ensures sufficient clearance next to the cam roller 3.

As a special feature, a cross section of the aperture 20 is comprised of an overlap between two pockets 22 and 23, which are illustrated by dashed lines in FIG. 3, the first pocket 22 being defined in a manner appropriate for passing the cam roller 3 through the web 6 and with an extent corresponding to the cam roller 3 in the axial direction, while the second pocket 23 is configured in such a way as to allow the needle ring 14 to project partially through the web 6 and with an extent corresponding to the needle ring 14 in the axial direction. In the longitudinal direction of the finger follower lever 1, the two pockets 22 and 23 are embodied in such a way that there is sufficient space available for the cam roller 3 and the needle ring 14 respectively. Overall, the overlap between the two pockets 22 and 23 gives rise to a cross-like cross section of the aperture 20, on the one hand providing sufficient guidance for the needles 15 of the needle ring 14 on the insides of the side walls 4 and 5 and on the other hand also forming an axial stop for the cam roller 3. By means of this axial guidance of the cam roller 3, especially when the finger follower lever 1 is used in a variable valve drive, in which movement of a cam contour takes place transversely to the finger follower lever 1, a tendency of the cam roller 3 to tilt during this movement is significantly reduced.

In the present case, the U-shaped lever 2 is formed as a sheet-metal part produced by a process which does not involve cutting, the forming process initially involving punching out a blank from sheet metal and then cold working it. The second pocket 23 is defined in the course of a bone cut, while the first pocket 22 is a later cut carried out in a subsequent working step and after the bending of the side walls 4 and 5.

Overall, the configuration of a finger follower lever 1 in the manner specified by the invention makes it possible, on the one hand, to improve valve guidance in the region of the valve actuating surface 7 through the U-shaped configuration of the profile of the lever body 2 and, on the other hand, makes it possible to reduce the mass and hence inertia of the lever body 2 through the configuration thereof. Moreover, surface pressure levels on the inner ring 16 due to the axial overhang of the needle ring 14 beyond the cam roller 3 can be kept down, despite the use of a cam roller 3 of narrow construction, thus allowing the use of the finger follower lever 1 in variable valve drive, e.g. sliding cam systems. Finally, the profile of the web 6 in the region of the cam roller 3 and the configuration of the aperture 20 make it possible to achieve a sufficient clearance in the region of the cam roller 3 and, at the same time, to achieve sufficient guidance for needles of the needle ring 14 on the side walls 4 and 5 and lateral guidance of the cam roller 3 in order to reduce axial backlash.

List of Reference Signs

| | |
|---|---|
| 1 | finger follower lever |
| 2 | lever body |
| 3 | cam roller |
| 4 | side wall |
| 5 | side wall |
| 6 | web |
| 7 | valve actuating surface |
| 8 | joint socket |
| 9 | holding clip |
| 10 | upper part |
| 11 | longitudinal arm |
| 12 | longitudinal arm |
| 13 | axle pin |
| 14 | needle ring |
| 15 | needles |
| 16 | inner ring |
| 17 | inner race |

-continued

| | |
|---|---|
| 18 | outer race |
| 19 | cam contact surface |
| 20 | aperture |
| 21 | flat |
| 22 | first pocket |
| 23 | second pocket |

The invention claimed is:

1. A finger follower lever for actuating a gas exchange valve of an internal combustion engine, comprising a lever body formed by two parallel side walls, which are spaced apart, and a transversely extending web which connects the side walls, the web forming in a region of a first end a joint socket which provides pivotable support for the lever body, and defining in a region of a second end a valve actuating surface provided for contact with the gas exchange valve, the side walls accommodating between them, in holes, an axle pin which guides a cam roller rotatably via a needle ring of a needle bearing, and the web defining a downwardly-open U-shaped profile of the lever body together with the side walls, at least between the second end and a positioning region of the cam roller, through which profile the cam roller projects partially via an aperture in the web for contact with a cam on a camshaft, the needle ring projects beyond the cam roller at least at one axial end, and ends directly adjacent to the corresponding side wall of the lever body at the at least one axial end, the web extending at a tangent to a radial extent of the needle ring in the positioning region of the cam roller, and the aperture having a cross section which is defined by an overlap between a first pocket for the cam roller, said first pocket having an extent corresponding to the cam roller in the axial direction, and a second pocket for the needle ring.

2. The finger follower lever as claimed in claim 1, wherein the needle ring projects axially beyond the cam roller on both sides and ends directly adjacent to the side walls at the axial ends, the second pocket having an extent corresponding to the needle ring in the axial direction.

3. The finger follower lever as claimed in claim 1, wherein the tangent-forming profile of the web in the region of the cam roller is formed by a flat.

4. The finger follower lever as claimed in claim 1, wherein the U-shaped profile of the lever body is defined over an entire length of the web.

5. The finger follower lever as claimed in claim 1, wherein a holding clip is provided on a same side as the joint socket.

6. The finger follower lever as claimed in claim 1, wherein the lever body is designed as a sheet-metal part.

7. The finger follower lever as claimed in claim 1, wherein the lever body is of symmetrical design with respect to a longitudinal center plane thereof.

* * * * *